US006375497B1

(12) United States Patent
DiFlora

(10) Patent No.: US 6,375,497 B1
(45) Date of Patent: Apr. 23, 2002

(54) RECESSED HERMETIC TERMINAL ASSEMBLY

(75) Inventor: Michael A. DiFlora, Adrian, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 09/466,278

(22) Filed: Dec. 17, 1999

(51) Int. Cl.[7] ..... H01R 13/73
(52) U.S. Cl. ..... 439/566; 417/422; 439/685
(58) Field of Search ..... 439/566, 935, 439/926, 685; 366/60; 417/422

(56) References Cited

U.S. PATENT DOCUMENTS

| | | | | |
|---|---|---|---|---|
| 1,991,350 A | | 2/1935 | Green | 200/152 |
| 2,138,660 A | | 11/1938 | Mann | 173/311 |
| 2,166,830 A | | 7/1939 | Thorson | 250/27.5 |
| 2,452,582 A | | 11/1948 | Litton | 250/27.5 |
| 3,148,300 A | | 9/1964 | Graff | 313/221 |
| 3,544,240 A | | 12/1970 | Rundell | 417/416 |
| 4,135,171 A | * | 1/1979 | Violet | 366/60 |
| 4,176,901 A | | 12/1979 | Ishimaru | 339/136 M |
| 4,252,394 A | | 2/1981 | Miller | 339/94 A |
| 4,964,788 A | | 10/1990 | Itameri-Kinter et al. | 417/422 |
| 5,199,898 A | * | 4/1993 | Wisner | 439/367 |
| 5,270,487 A | | 12/1993 | Sawamura | 174/31 R |

* cited by examiner

*Primary Examiner*—Tho D. Ta
*Assistant Examiner*—Phuong Nguyen
(74) *Attorney, Agent, or Firm*—Baker & Daniels

(57) ABSTRACT

A hermetic compressor comprising a hermetic housing having a cylindrical sidewall portion, a portion of the sidewall disposed inwardly creating a recess, and a hermetic terminal assembly disposed in an opening in the recess to carry electric current into the housing. The terminal assembly includes a plurality of conductive pins each having an external portion preferably completely disposed in the recess so that the pins are completely shielded by the recess.

5 Claims, 2 Drawing Sheets

RECESSED HERMETIC TERMINAL ASSEMBLY

BACKGROUND OF THE INVENTION

1. Field of the Invention

The present invention relates generally to hermetic compressors of the type having a hermetic housing wherein a terminal assembly is provided for carrying electric current into the housing and, more particularly, to such a compressor having the terminal assembly in the sidewall of the housing.

2. Description of the Related Art

Terminal assemblies for hermetic compressors are well known in the art and generally comprise a cup-shaped metallic body member having a plurality of metallic conductor pins extending therethrough. The pins are generally glass sealed to the cup member to prevent leakage to the atmosphere. A cluster block or female socket arrangement attaches to the hermetic terminal to provide electrical current through the hermetic terminal to the electric motor inside the housing.

The terminal assemblies are often placed on the sidewall of a hermetic compressor housing and can include an external shield to cover and protect the female socket and terminal assembly. An example of such a hermetic compressor with an external terminal shield is disclosed in U.S. Pat. No. 5,199,898 (Wisner), which is assigned to the assignee of the present invention and expressly incorporated herein by reference.

A disadvantage associated with terminal assemblies on hermetic compressors is that the conductor pins in the terminal assembly extend outside of the compressor housing increasing the effective envelope of the compressor.

Another disadvantage associated with existing terminal assemblies on hermetic compressors is the possibility of damage to either the conductor pins or glass seal extending out of the compressor housing.

SUMMARY OF THE INVENTION

The present invention provides a hermetic compressor having a cylindrical housing wherein a sidewall area of the housing is brought inward to create an inwardly extending recess in the sidewall. The compressor's terminal assembly is disposed within an opening in the recess reducing the radial extension of the terminal assembly from the housing, thereby providing some protection for the terminal assembly and reducing the effective envelope of the compressor. The lengths of the external portions of the conductive pins may be greater than, equal to, or less than the depth of the recess.

One advantage of the recessed terminal cluster of the present invention is that the effective envelope of the hermetic compressor is reduced.

Another advantage of the recessed terminal cluster of the present invention is that the possibility of damage to either the conductor pins or the sealing glass is significantly reduced.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
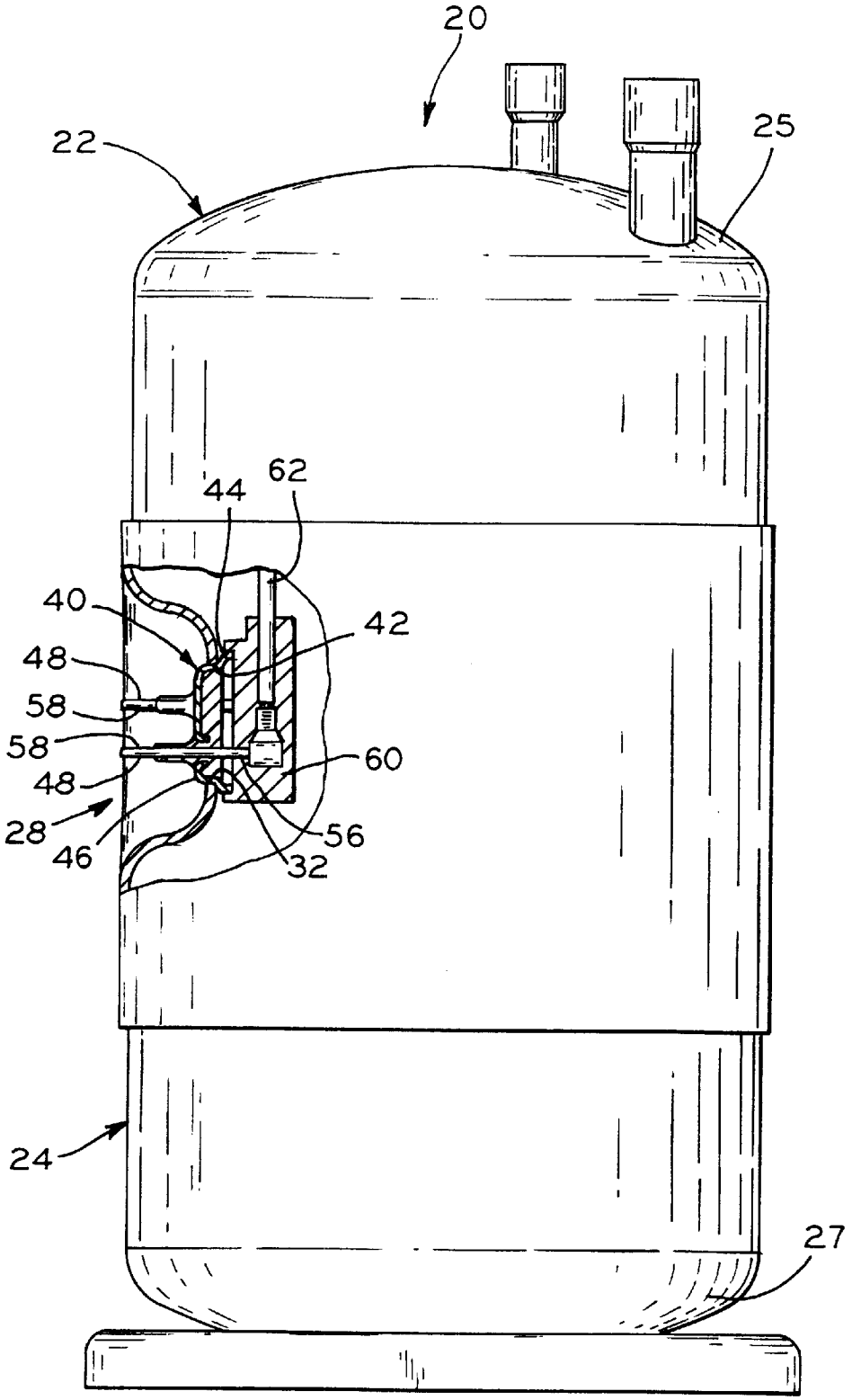
FIG. 1 is an elevation view, partially in section, of a hermetic compressor including the recessed hermetic terminal assembly of the present invention.

Corresponding reference characters indicate corresponding parts throughout the several views. Although the drawings represent an embodiment of the present invention, the drawings are not necessarily to scale and certain features may be exaggerated in order to better illustrate and explain the present invention. The exemplification set out herein illustrates an embodiment of the invention, in one form, and such exemplification is not to be construed as limiting the scope of the invention in any manner.

DESCRIPTION OF THE PRESENT INVENTION

Referring to FIG. 1, there is shown the recessed hermetic terminal assembly of the present invention provided in the housing of a hermetic compressor of conventional design, such as disclosed in U.S. Pat. No. 5,785,151 (Fry et al.), which is assigned to the assignee of the present invention and expressly incorporated herein by reference. Housing 22 of compressor 20 includes vertical cylindrical sidewall portion 24, top portion 25, and bottom portion 27. Hermetic terminal assembly 40 is hermetically sealed to opening 32 within recess 28 formed in housing 22.

Figure 2:
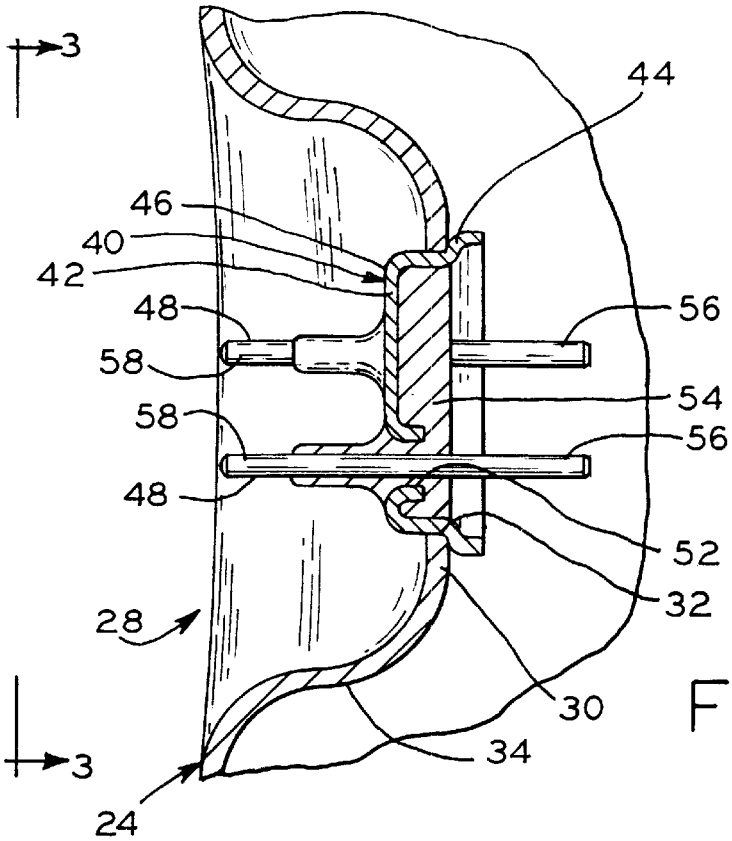
FIG. 2 is an enlarged, fragmentary view of the recessed hermetic terminal assembly.
Figure 3:
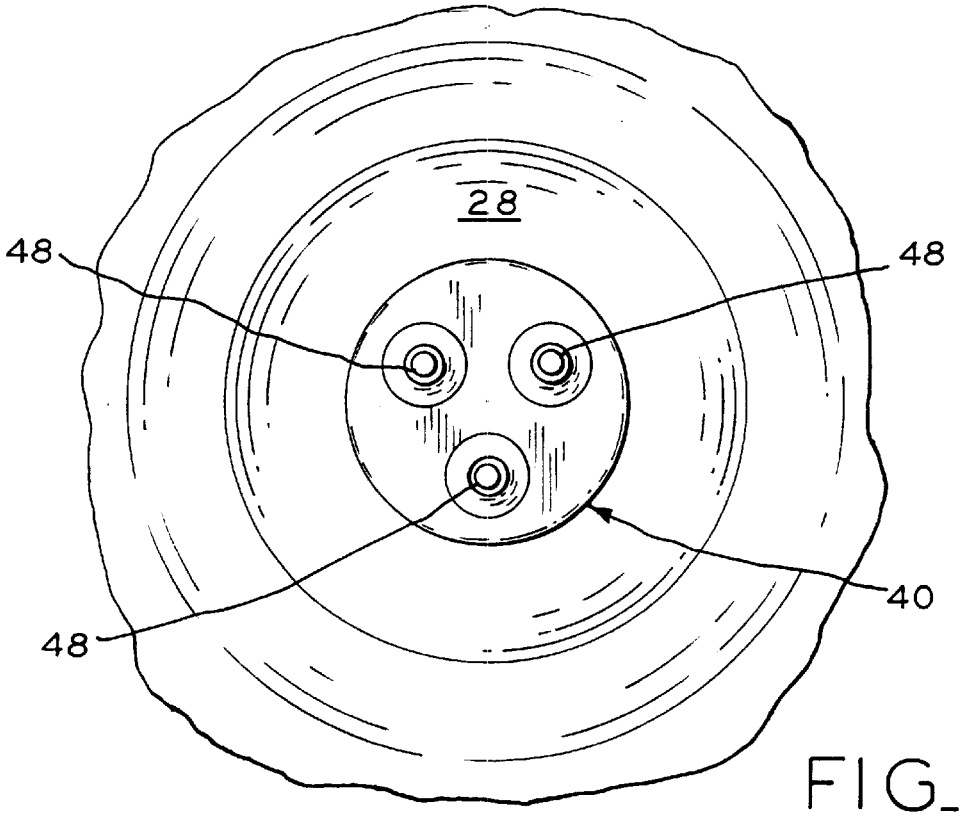
FIG. 3 is a view of the recessed hermetic terminal assembly along line 3—3 of FIG. 2.

Referring now to FIG. 2, a portion of cylindrical sidewall 24 is recessed inwardly to a certain depth to create recess 28. Recess 28 includes recessed wall portion 30, tapered wall area 34 joining the cylindrical portion of sidewall 24 to recessed wall portion 30, and opening 32 into which hermetic terminal assembly 40 is welded or otherwise hermetically sealed. As shown in FIG. 3, recess 28 is preferably circular with terminal assembly 40 disposed in the center of recessed wall portion 30 allowing room for the connection of a removable terminal block (not shown).

Hermetic terminal assembly 40 is of known construction comprising metallic, cup-shaped member 42 having flange 44 and center portion 46, and openings 52. Flange 44 is disposed against the inner surface of opening 32 where terminal assembly 40 is welded in place. Metallic conductive terminal pins 48 are received and retained within each of openings 52, and are sealed into openings 52 and electrically insulated from cup member 42 by glass seal 54. The internal ends 56 of conductor pins 48 are disposed internally of housing 22 and are electrically connected to the compressor motor (not shown) by means of leads 62 and connector block 60. External ends 58 of conductor pins 48 are disposed externally of housing 22 and connect to a removable terminal block (not shown) providing electrical power to compressor 20. The lengths of external ends 58 of pins 48 are preferably less than the depth of recess 28 so that they do not extend outside the outer periphery of sidewall 24.

The depth of the inward recess could be greater than, equal to or less than the length of the conductor pins extending from the housing. If the depth of the recess is greater than or equal to the length of the conductor pins extending from the housing, then the pins are completed shielded by the compressor housing and do not increase the effective envelope of the compressor. If the depth of the recess is less than the length of the conductor pins, then the pins are partially exposed outside of the compressor housing and cause a slight increase to the effective envelope of the compressor.

During transportation and installation, housing recess 28 provides partial or complete protection of conductor pins 48 and glass seal 54 while reducing the effective envelope of the compressor depending on the depth of recess 28 and the length of pins 48. This helps to prevent damage to pins 48 and seal 54 and allows compressor 20 to occupy less space during transportation and installation.

The above embodiment describes the hermetic compressor of the present invention having a vertical cylindrical sidewall with top and bottom portions. However, the present invention is equally applicable to a compressor having a horizontal cylindrical sidewall or a cylindrical sidewall at an angle between vertical and horizontal.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A hermetic compressor comprising:

a hermetic housing having a cylindrical sidewall portion;

an electric motor and a compressor unit driven by said motor, said motor and compressor unit mounted in said hermetic housing;

a plurality of leads connected to said motor;

a portion of said sidewall portion including an inwardly extending recess, said recess having an opening therein; and a hermetic terminal assembly comprising a member and a plurality of electrically conductive pins supported by said member and insulated therefrom, said member mounted in said opening of said recess, wherein said pins each have an internal portion connected to a respective said lead and an external portion extending externally of said housing and at least partially disposed in said recess.

2. The compressor of claim 1, wherein said plurality of conductive pins external portions are completely disposed in said recess.

3. The compressor of claim 1, wherein said terminal assembly includes three said conductive pins and a glass seal.

4. The compressor of claim 1, wherein said terminal assembly is welded to said housing.

5. The compressor of claim 1, wherein said cylindrical portion of said housing is vertical.

* * * * *